US007377886B2

(12) United States Patent
Wu

(10) Patent No.: US 7,377,886 B2
(45) Date of Patent: May 27, 2008

(54) ADJUSTABLE PULL EXERCISER

(76) Inventor: Ying-Ching Wu, No. 25, Shin-Chi Village, Tainan County, An-Ding Shiang (TW)

( * ) Notice: Subject to any disclaimer, the term of this patent is extended or adjusted under 35 U.S.C. 154(b) by 397 days.

(21) Appl. No.: 11/161,841

(22) Filed: Aug. 18, 2005

(65) Prior Publication Data

US 2007/0042881 A1 Feb. 22, 2007

(51) Int. Cl.
*A63B 21/00* (2006.01)

(52) U.S. Cl. ..... 482/126; 482/121

(58) Field of Classification Search ..... 482/121–126, 482/148, 907, 904

See application file for complete search history.

(56) References Cited

U.S. PATENT DOCUMENTS

| | | | | |
|---|---|---|---|---|
| 1,524,108 | A | 1/1925 | Rowland | 24/129 R |
| 4,225,131 | A | 9/1980 | Sidlinger et al. | 272/109 |
| 4,733,862 | A | 3/1988 | Miller | 272/137 |
| 5,431,617 | A | 7/1995 | Rattray, Jr. | 482/129 |
| 5,556,368 | A | 9/1996 | Akin | 482/124 |
| 5,665,040 | A * | 9/1997 | Ho | 482/126 |
| 5,885,196 | A * | 3/1999 | Gvoich | 482/125 |
| 6,497,641 | B1 | 12/2002 | Hinds | 482/126 |
| 6,500,105 | B1 | 12/2002 | Kuo | 482/123 |
| 6,676,576 | B1 * | 1/2004 | Wu | 482/126 |
| 2005/0075223 | A1 | 4/2005 | Wu | 482/126 |
| 2005/0137066 | A1 | 6/2005 | Wu | 482/126 |

* cited by examiner

*Primary Examiner*—Jerome Donnelly
(74) *Attorney, Agent, or Firm*—Alan Kamrath; Kamrath & Associates PA

(57) ABSTRACT

A pull exerciser includes two attachment members, two positioning devices respectively attached to the attachment members at a location opposite to a grip portion of an associated attachment member, and at least one resilient cord. Each positioning device includes a positioning block and a positioning plate removably received in the positioning block. Each of the positioning blocks and the positioning plates includes at least one positioning hole. The resilient cord has two ends extendible through the positioning hole of each positioning block and each positioning plate. An end piece is fixed to each end of the resilient cord. The end pieces of the resilient cord are mounted to at least one of the positioning plates.

20 Claims, 9 Drawing Sheets

ADJUSTABLE PULL EXERCISER

BACKGROUND OF THE INVENTION

1. Field of the Invention

The present invention relates to a pull exerciser having at least one replaceable resilient cord.

2. Description of the Related Art

FIG. 1 of the drawings illustrates a conventional pull exerciser including two attachment members 20 each having a hole 201 , a resilient cord 1 having two ends respectively extending through the holes 201 of the attachment members 20 , with an end piece 11 being attached to each end of the resilient cord 1 , and two handles 2 respectively mounted to the attachment members 20. Each end piece 11 has a diameter greater than that of the hole 201 of the respective attachment member 20 to prevent the resilient cord 1 from disengaging from the respective attachment member 20 . A user may grasp the handles 2 and pull the resilient cord 1 with both hands to exercise muscles of the arms and the chest. A disadvantage of this conventional pull exerciser is that the resilient cord 1 could not be replaced with another resilient cord having a different elastic coefficient. Once the resilient cord 1 loses its resiliency, the whole pull exerciser has to be discarded. U.S. Pat. No. 6,676,576 discloses an adjustable pull exerciser including two attachment members, two handles respectively mounted on the attachment members, and at least one resilient cord attached between the attachment members. The resilient cord can be replaced with a new one when desired. Two positioning devices are respectively attached to the attachment members and each include a first positioning plate and a second positioning plate. Each of the first positioning plate and the second positioning plate includes at least one positioning hole in communication with outside via a reduced opening having a width smaller than a diameter of the positioning hole. The resilient cord is so sized to be extendible through the positioning holes of the first and second positioning plates. An end piece is fixed to each end of the resilient cord and has a diameter greater than that of the positioning holes of the first and second positioning plates. Each attachment member is adjustable in length to allow the associated first positioning plate and the associated second positioning plate to be spaced apart from each other for allowing removal/mounting of the resilient cord and to allow the associated first positioning plate to be in contact with the associated second positioning plate after removal/mounting of the resilient cord. However, when the resilient cord is subject to a relatively large force during use, the respective first positioning plates are liable to be spaced apart from or to turn relative to the respective second positioning plates, resulting in undesired disengagement of the resilient cord.

SUMMARY OF THE INVENTION

An object of the present invention is to provide an adjustable pull exerciser comprising at least one resilient cord that is reliably positioned while allowing a user to replace the resilient cord with another resilient cord having a different elastic coefficient.

Another object of the present invention is to provide an adjustable pull exerciser that has a plurality of reliably positioned resilient cords while allowing a user to attach additional resilient cords to or remove some of resilient cords from the pull exerciser when desired.

In accordance with an aspect of the present invention, a pull exerciser comprises two attachment members each having a grip portion, two positioning devices respectively attached to the attachment members at a location opposite to the grip portion of an associated one of the attachment members, and at least one resilient cord.

Each positioning device includes a positioning block and a positioning plate removably received in the positioning block. Each of the positioning blocks and the positioning plates includes at least one positioning hole. The resilient cord has two ends extendible through the positioning hole of each positioning block and each positioning plate. An end piece is fixed to each end of the resilient cord. The end pieces of the resilient cord are mounted to at least one of the positioning plates.

Preferably, each positioning block comprises a compartment for fittingly receiving an associated positioning plate.

Preferably, each attachment member is a belt, and the pull exerciser further comprises a tubular handle mounted around each belt.

Preferably, each positioning block comprises two slots in two sides thereof, and each belt extends through the slots of an associated positioning block.

Preferably, each attachment member is adjustable in length.

In a first example of the invention, the positioning hole of each positioning block has a diameter greater than that of the end pieces of the resilient cord.

In a second example of the invention, the positioning hole of each positioning block has a diameter smaller than that of the end pieces of the resilient cord. The positioning hole of each positioning block is communicated with outside via a reduced opening having a width smaller than a diameter of the positioning hole of each positioning block and together forming a slot, allowing the resilient cord to be inserted into the positioning hole of each positioning block via the reduced opening of the positioning hole of each positioning block.

In a modified embodiment of the first example of the invention, each positioning block further comprises at least one second positioning hole having a diameter smaller than that of the end pieces of the resilient cord. The second positioning hole of each positioning block is communicated with outside via a reduced opening having a width smaller than a diameter of the second positioning hole of each positioning plate and together forming a slot, allowing the resilient cord to be inserted into the second positioning hole of each positioning block via the reduced opening of the second positioning hole of each positioning block.

Preferably, the positioning hole of each positioning plate has a diameter smaller than that of the end pieces of the resilient cord. The positioning hole of each positioning plate is communicated with outside via a reduced opening having a width smaller than a diameter of the positioning hole of each positioning plate and together forming a slot, allowing the resilient cord to be inserted into the positioning hole of each positioning plate via the reduced opening.

In accordance with another aspect of the present invention, a pull exerciser comprises two tubular handles, two length-adjustable belts each extending through an associated tubular handle, two positioning devices respectively attached to the belts at a location opposite to an associated tubular handle, and a plurality of resilient cords.

Each positioning device includes a positioning block and a positioning plate removably received in the positioning block. Each of the positioning blocks and the positioning plates has a plurality of positioning holes. Each positioning hole of each positioning plate is communicated with outside via a reduced opening having a width smaller than a diameter of each positioning hole of each positioning plate and together forming a slot.

Each of two ends of each resilient cord is insertable into an associated one of the positioning holes through the reduced opening of the associated positioning hole. Each resilient cord is extendible through the positioning holes of each positioning block. An end piece is fixed to each end of each resilient cord and has a diameter greater than the diameter of each positioning hole of the positioning plates. At least one of the resilient cords is selectively attached to the positioning devices.

Preferably, the resilient cords have different elastic coefficients.

Preferably, each positioning hole of each positioning plate is aligned with an associated positioning hole of an associated positioning block.

Preferably, each attachment member is adjustable in length.

In a first example of the invention, each positioning hole of each positioning block has a diameter greater than that of the end pieces of each resilient cord.

In a second example of the invention, each positioning hole of each positioning block has a diameter smaller than that of the end pieces of each resilient cord. Each positioning hole of each positioning block is communicated with outside via a reduced opening having a width smaller than a diameter of each positioning hole of each positioning block and together forming a slot, allowing each resilient cord to be inserted into the positioning holes of the positioning blocks via the reduced opening of each positioning hole of each positioning block.

Preferably, each reduced opening of each positioning plate faces in a direction opposite to that of an associated reduced opening of an associated positioning block.

In a third example of the invention, at least one of the positioning holes of each positioning block has a diameter smaller than that of the end pieces of each resilient cord. The at least one of the positioning holes of each positioning block is communicated with outside via a reduced opening having a width smaller than a diameter of each positioning hole of each positioning block and together forming a slot, allowing an associated resilient cord to be inserted into the at least one of the positioning holes of the positioning blocks via the reduced opening of the at least one of the positioning hole of each positioning block. At least one of the remaining positioning holes of each positioning block has a diameter greater than that of the end pieces of the resilient cords.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
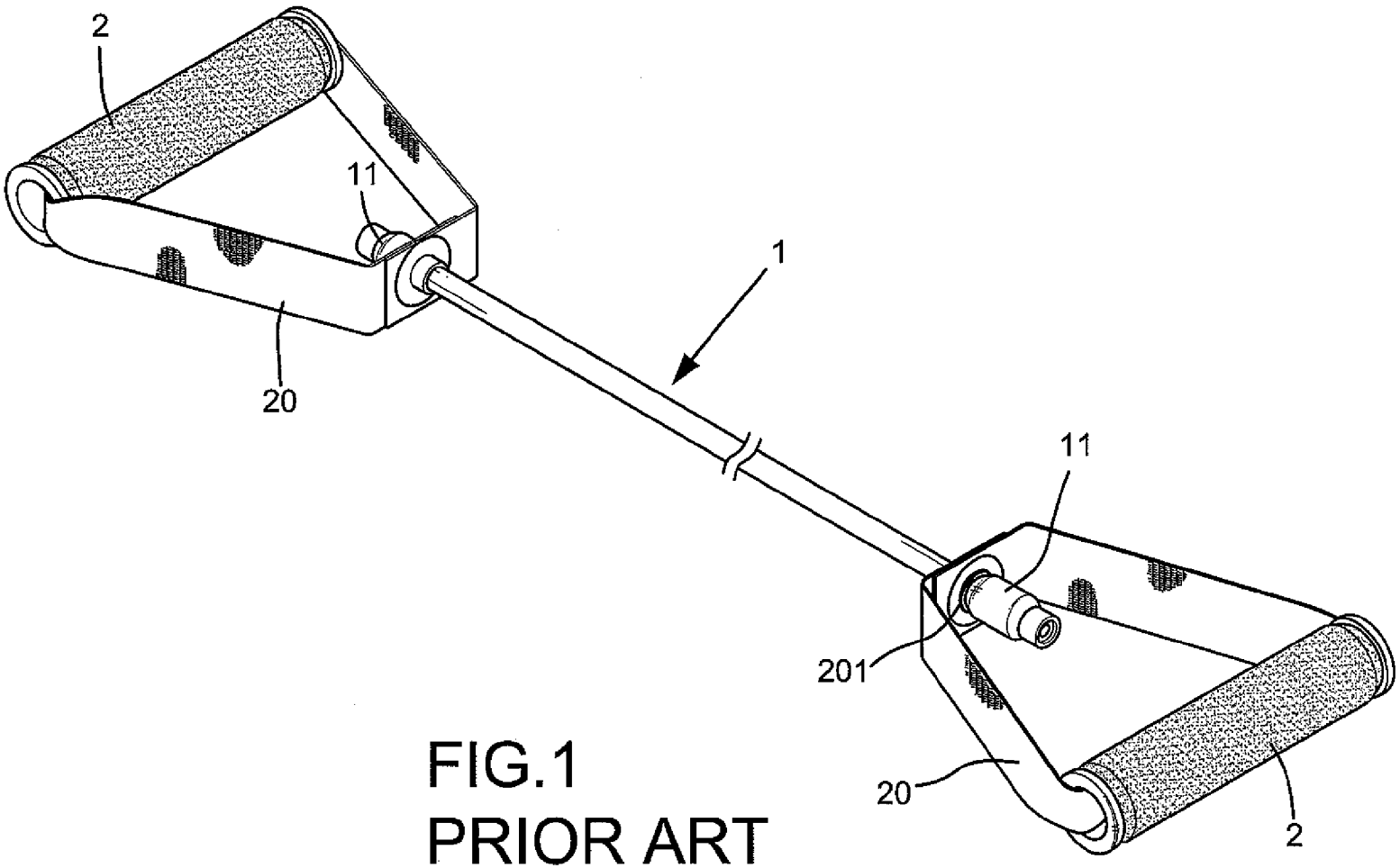
FIG.1 PRIOR ART
FIG. 1 is a perspective view of a conventional pull exerciser.
Figure 2:
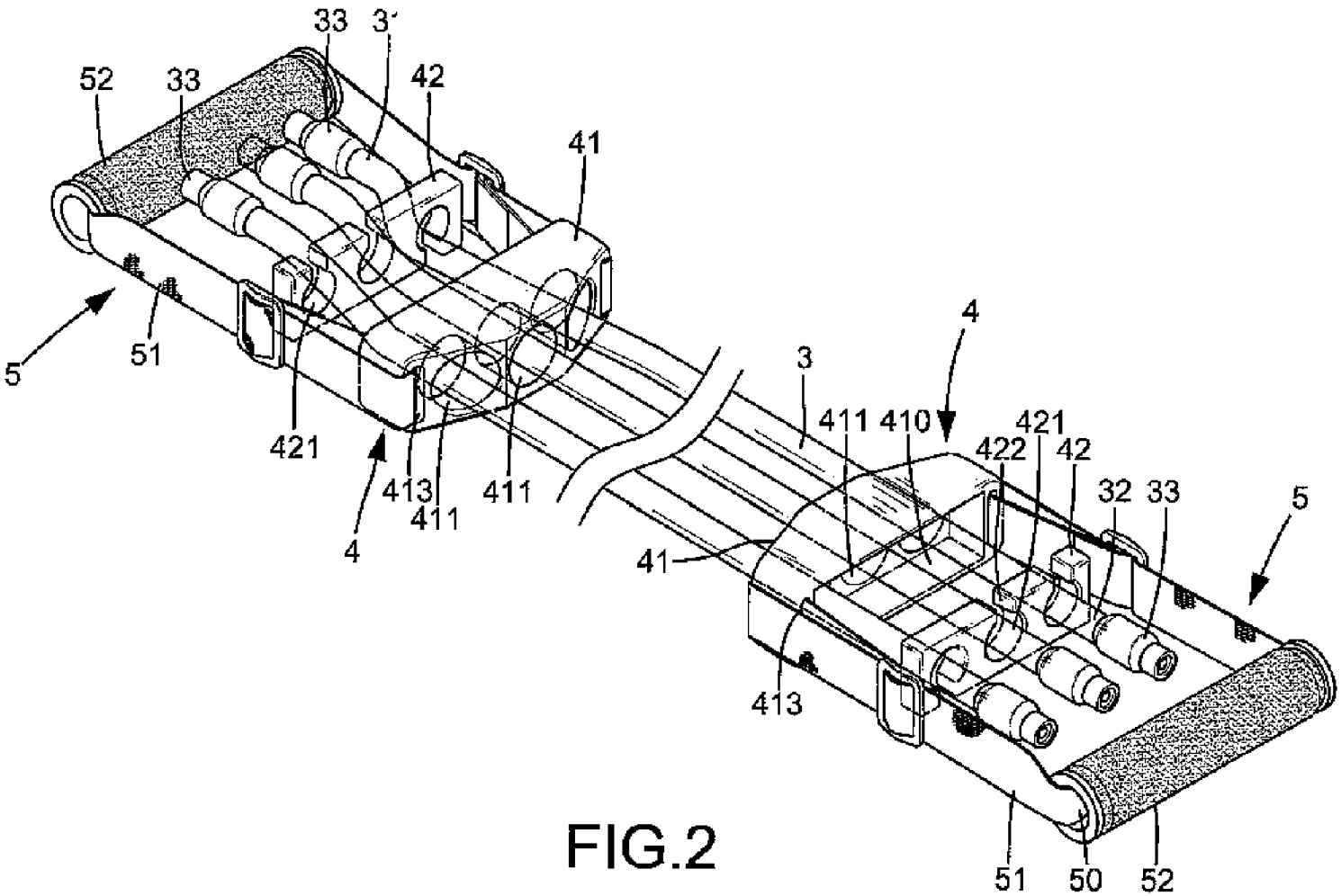
FIG. 2 is a perspective view of a pull exerciser in accordance with the present invention.

Referring to FIG. 2, an adjustable pull exerciser in accordance with the present invention generally comprises two attachment members 5, two positioning devices 4, and at least one resilient cord 3. In this embodiment, there are three resilient cords 3 each having an end piece 33 attached to each of two ends 31 and 32 thereof, and each attachment member 5 is in the form of a belt 51 whose length is adjustable. The belt 51 includes a grip portion 50 for a user's grip. Alternatively, a tubular handle 52 is mounted around the grip portion 50 for easier grip.

Figure 3:
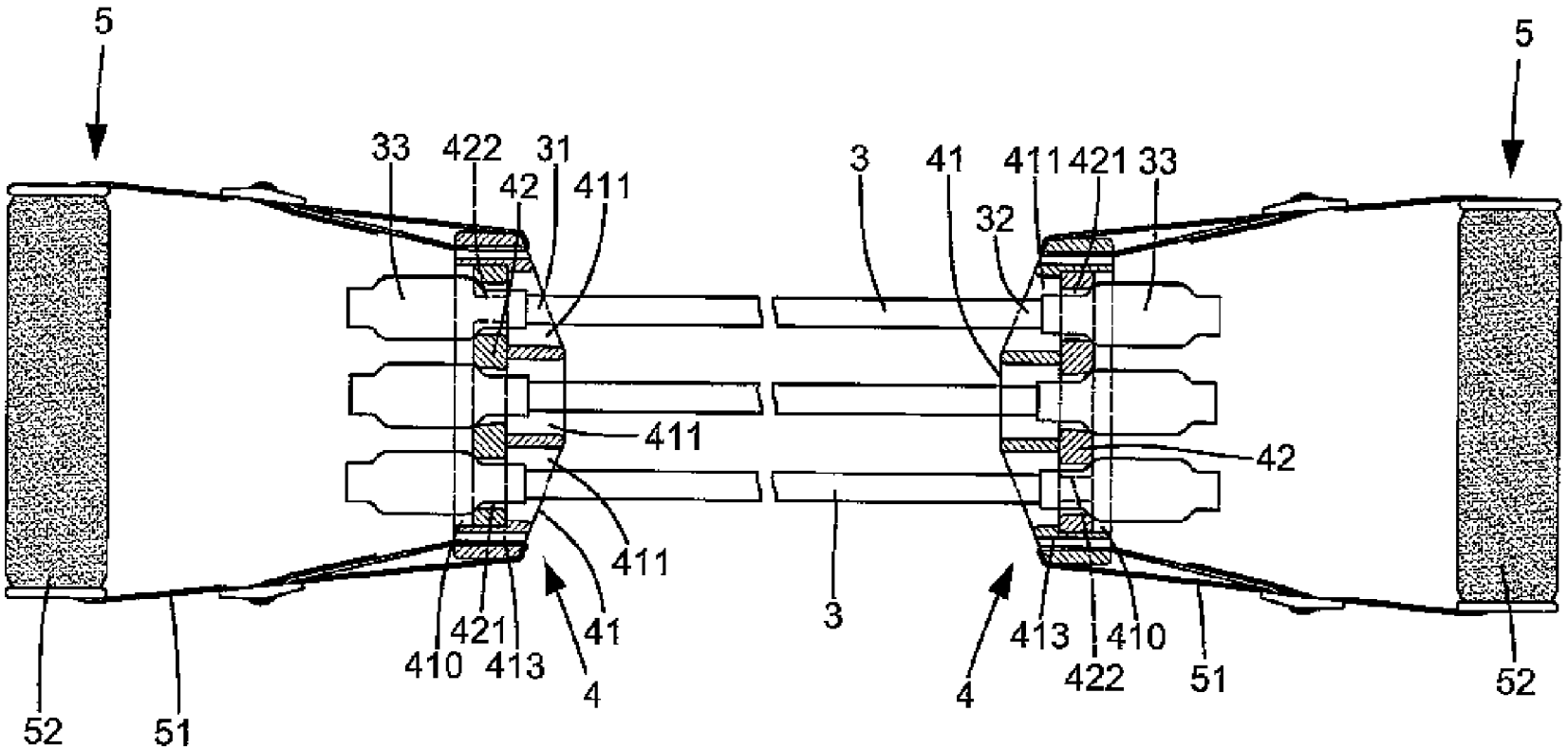
FIG. 3 is a sectional view of the pull exerciser in accordance with the present invention.

Referring to FIGS. 2 and 3, each positioning device 4 includes a positioning block 41 and a positioning plate 42 removably received in the positioning block 41. Preferably, each positioning block 41 includes a compartment 410 for fittingly accommodating the associated positioning plate 42. Each positioning block 41 further includes a slot 413 in each of two ends thereof. Each belt 51 is extended through an associated handle 52 and the slots 413 of the associated positioning block 41. The length of each belt 51 may be adjusted according to the user's needs.

Each positioning block 41 includes at least one positioning hole 411, and each positioning plate 42 includes at least one positioning hole 421 In the illustrated embodiment, each positioning block 41 includes three positioning holes 411, and each positioning plate 42 includes three positioning holes 421 respectively aligned with the positioning holes 411 of the associated positioning block 41 Further, each positioning hole 411 of each positioning block 41 has a diameter greater than that of the end pieces 33 of the resilient cords 3, allowing the resilient cords 3 to directly extend through the positioning holes 411. Each positioning hole 421 of each positioning plate 42 has a diameter smaller than that of the end pieces 33 of the resilient cords 3. Further, each positioning hole 421 is communicated with outside via a reduced opening 422 having a width smaller than the diameter of the positioning hole 421. Positioning hole 421 and opening 422 together form a slot.

Each end 31, 32 of each resilient cord 3 that has extended through the positioning holes 411 can be inserted into an associated positioning hole 421 of the associated positioning plate 42, with each end piece 33 being partially extended into an associated positioning hole 421, as shown in FIG. 2. Each resilient cord 3 is reliably positioned. Each positioning plate 42 is then placed into the associated positioning block 41. The end piece 33 on each end 31, 32 of each resilient cord 3 has a diameter greater than that of the associated positioning hole 421, thereby preventing the resilient cord 3 from disengaging from the associated positioning hole 421.

Figure 4:
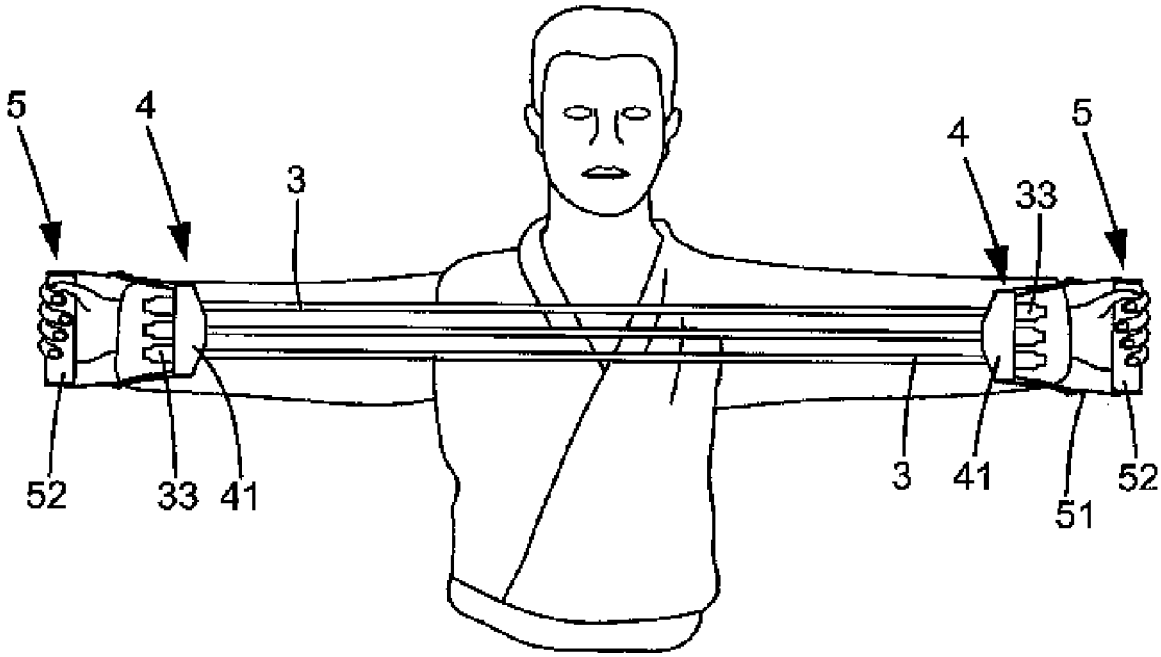
FIG. 4 is a schematic view illustrating use of the pull exerciser in accordance with the present invention.

The user may grip the handles 52 and pull the resilient cords 3 for exercise purposes, as shown in FIG. 4. If adjustment is required, the user may separate the positioning plates 42 from the positioning blocks 41. Then, the user may replace at least one of the resilient cords 3 with another resilient cord having a different elastic coefficient. Further, the user may remove one or two of the resilient cords 3 from the pull exerciser. The pull resistance of the pull exerciser is accordingly altered.

Since the positioning plates 42 are received in the positioning blocks 41 after assembly, the positioning plates 42 could not turn in or disengage from the positioning blocks 41. Further, the positioning devices 4 are improved in strength and thus prolong the life of the pull exerciser.

Figure 5:
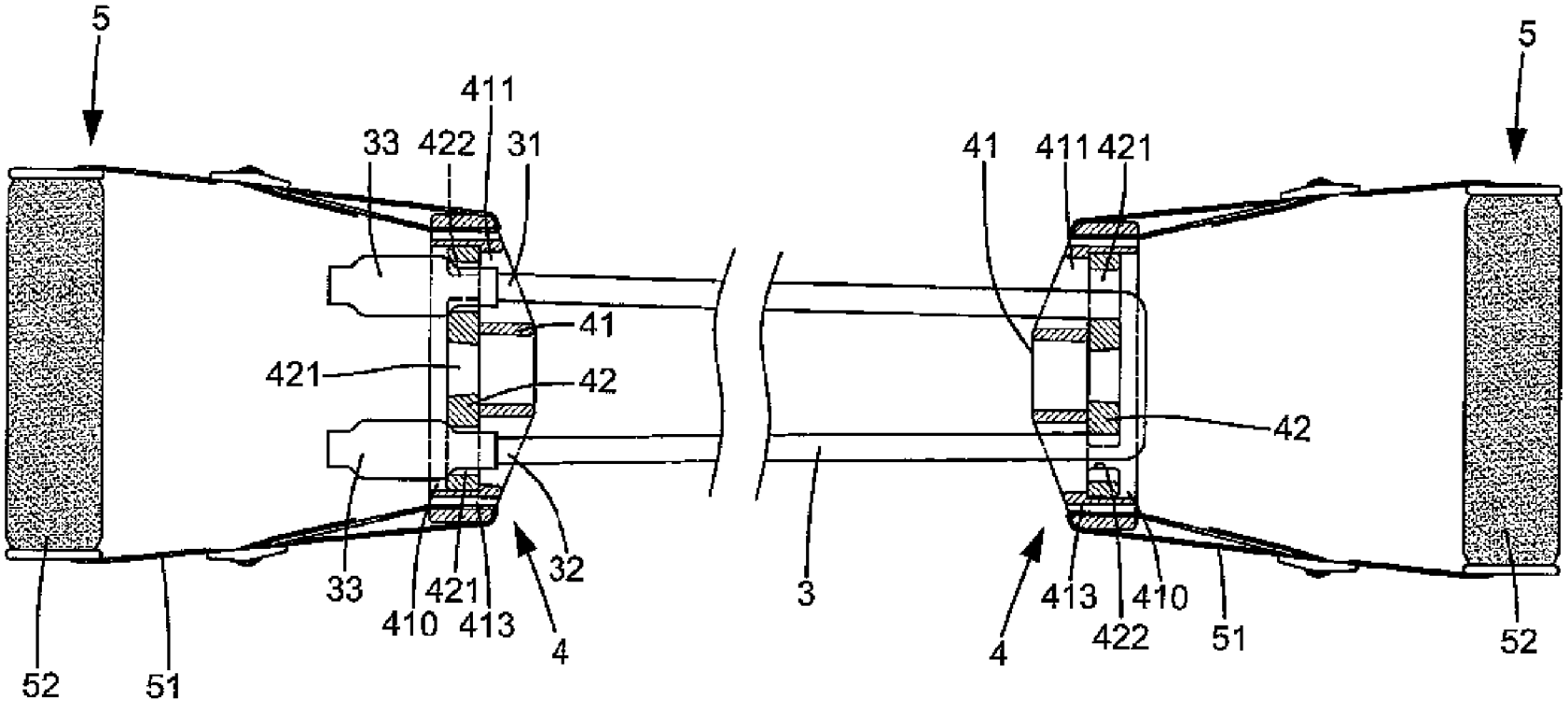
FIG. 5 is a sectional view illustrating the pull exerciser in accordance with the present invention using only one resilient cord.

FIG. 5 illustrates use of the pull exerciser with only one resilient cord 3. The resilient cord 3 is extended through the positioning blocks 41 and the positioning plates 42, with both end pieces 33 of the resilient cord 3 being partially inserted into two positioning holes 421 of one of the positioning blocks 41.

Figure 6:
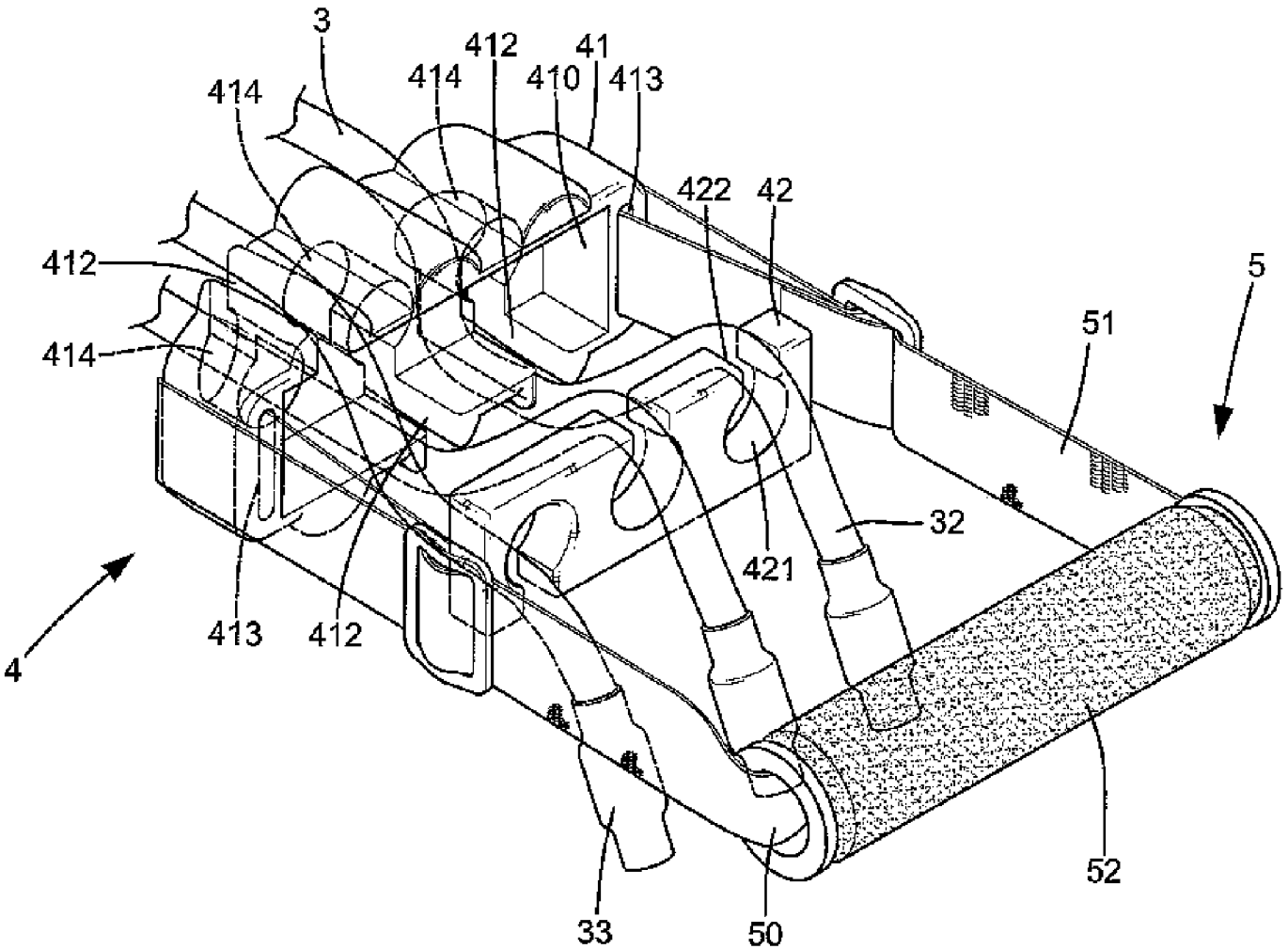
FIG. 6 is a partial perspective view of a modified embodiment of the pull exerciser in accordance with the present invention.
Figure 7:
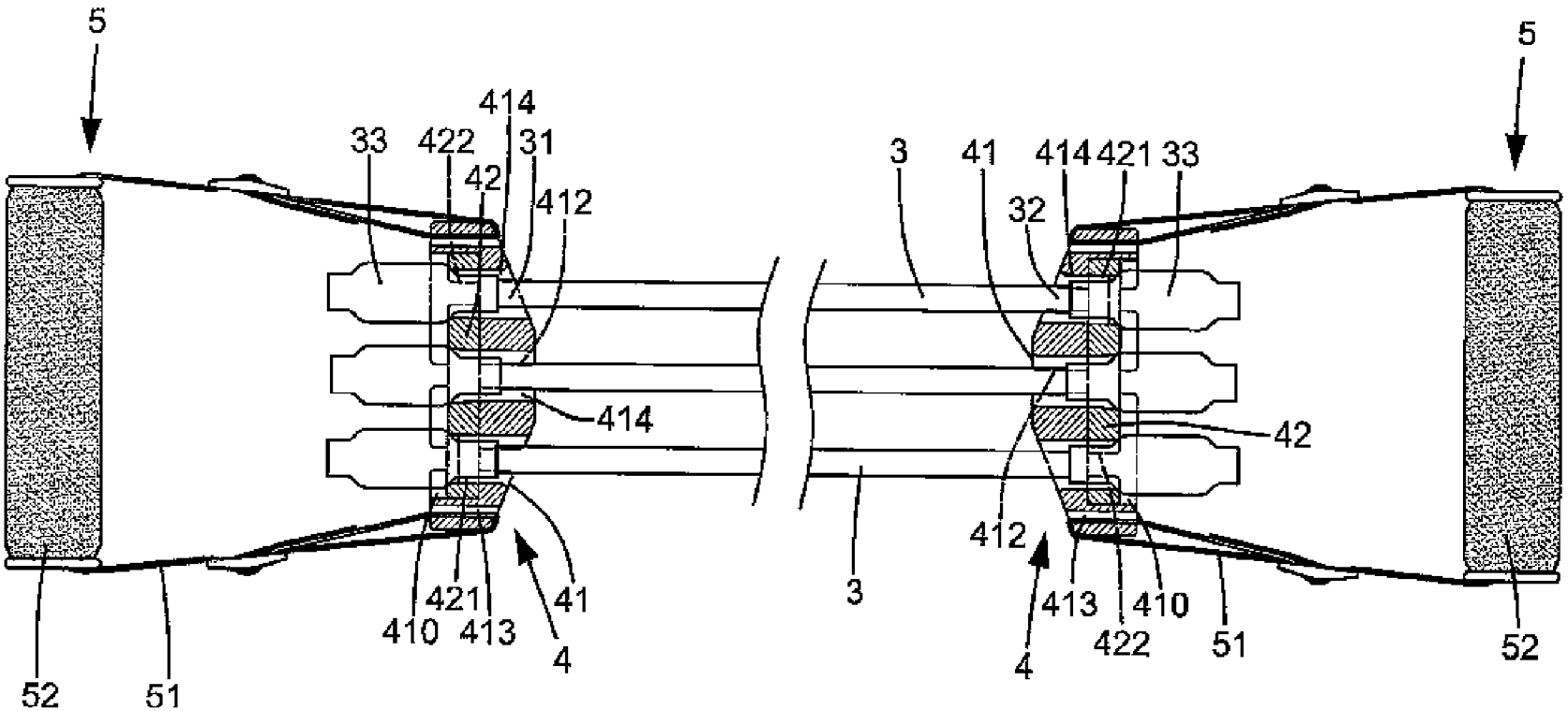
FIG. 7 is a sectional view of the pull exerciser in FIG. 6.

FIGS. 6 and 7 illustrate a modified embodiment of the invention, wherein each positioning block 41 includes a plurality of positioning holes 414 each having a diameter smaller than that of the end pieces 33 of the resilient cords 3. Further, each positioning hole 414 is communicated with outside via a reduced opening 412 having a width smaller than the diameter of the positioning hole 414. Positioning hole 414 and reduced opening 412 together form a slot. Thus, each resilient cord 3 has to be inserted into the associated positioning holes 414 via the associated reduced openings 412. Preferably, the reduced opening 412 of each positioning hole 414 faces in a direction opposite to that of an associated positioning hole 422 of the associated positioning block 42.

Figure 8:
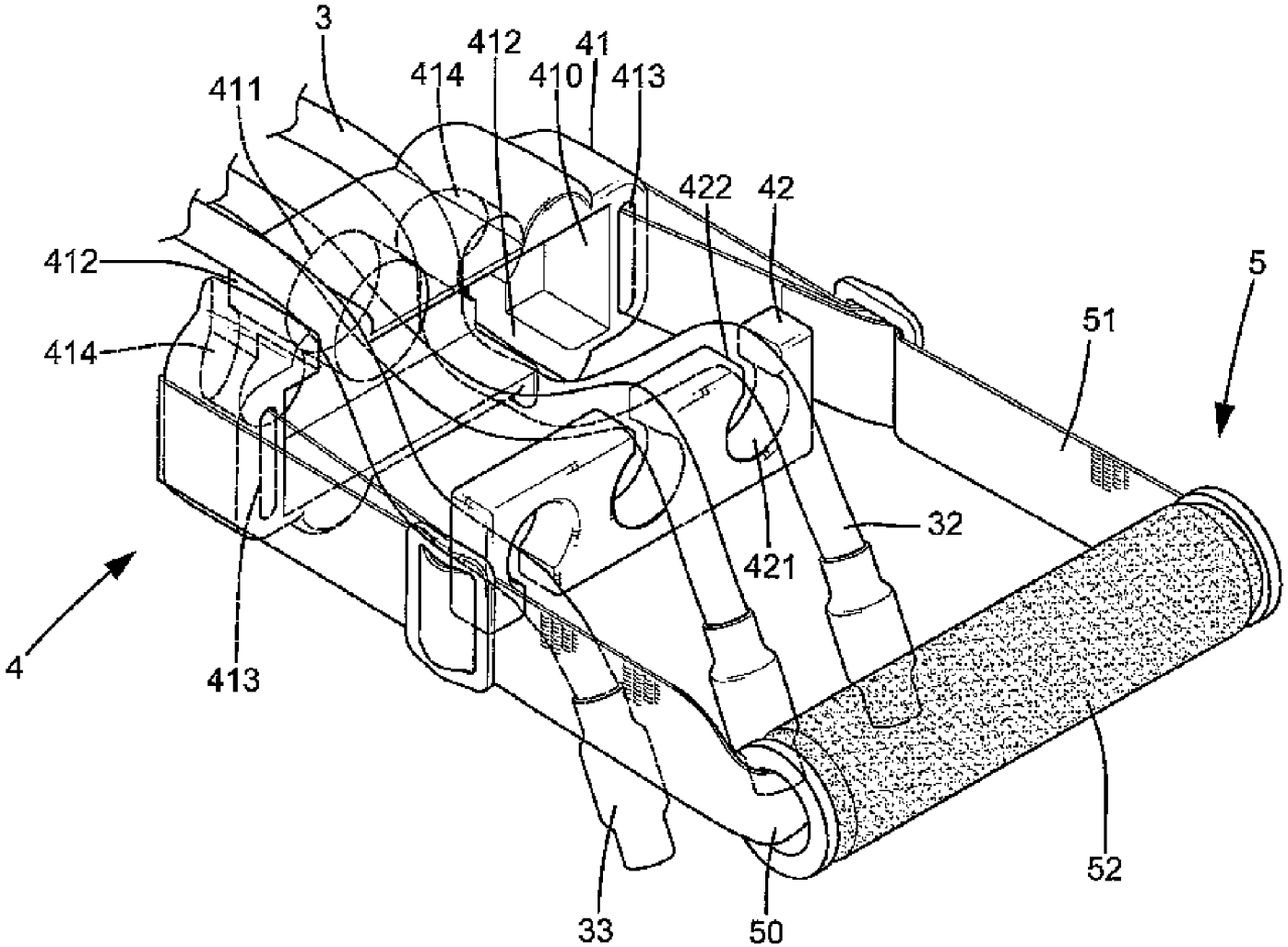
FIG. 8 is a partial perspective view of another modified embodiment of the pull exerciser in accordance with the present invention.
Figure 9:
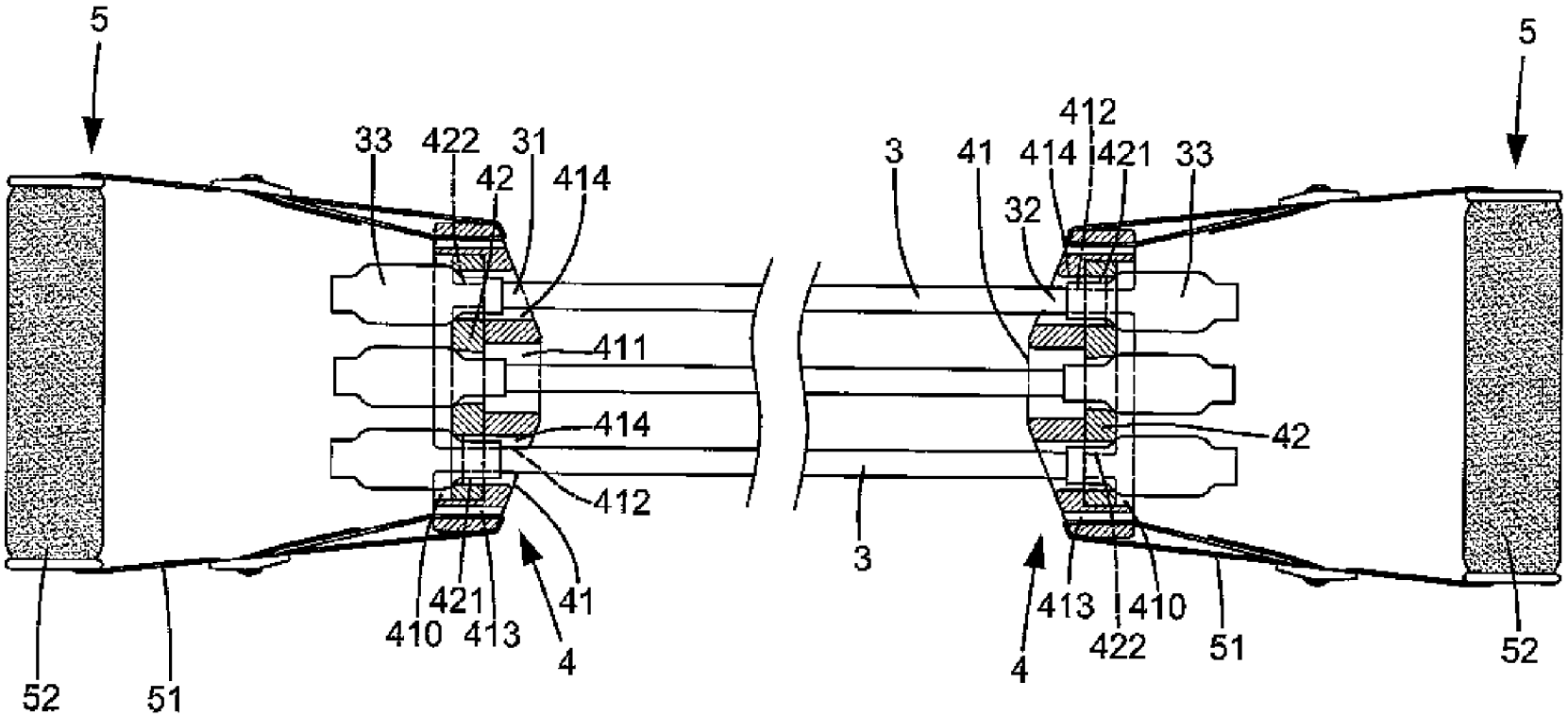
FIG. 9 is a sectional view of the pull exerciser in FIG. 8.

FIGS. 8 and 9 illustrate another modified embodiment of the invention, wherein each positioning block 41 includes a plurality of positioning holes 414. Some of the positioning holes 414 have a diameter smaller than that of the end pieces 33 of the resilient cords 3 whereas the other positioning holes 414 have a diameter greater than that of the end pieces 33 of the resilient cords 3. Each positioning hole 414 having a smaller diameter is communicated with outside via a reduced opening 412 having a width smaller than the diameter of the positioning hole 421.

Although specific embodiments have been illustrated and described, numerous modifications and variations are still possible without departing from the essence of the invention. The scope of the invention is limited by the accompanying claims.

What is claimed is:

1. A pull exerciser comprising: two attachment members each having a grip portion; two positioning devices respectively attached to the attachment members at a location opposite to the grip portion of an associated one of the attachment members, each said positioning device including a positioning block and a positioning plate removably received in the positioning block, each of the positioning blocks and the positioning plates including at least one positioning hole; and at least one resilient cord having two ends extendible through said at least one positioning hole of each said positioning block and each said positioning plate, an end piece being fixed to each of the ends of said at least one resilient cord, the end pieces of said at least one resilient cord being mounted to at least one of the positioning plates.

2. The pull exerciser as claimed in claim 1, with each said positioning block comprising a compartment for fittingly receiving an associated one of the positioning plates.

3. The pull exerciser claimed in claim 1, with each said attachment member being a belt, and with the pull exerciser further comprising a tubular handle mounted around each said belt.

4. The pull exerciser as claimed in claim 3, with each said positioning block comprising two slots in two sides thereof, with each said belt extending through the slots of an associated one of the positioning blocks.

5. The pull exerciser as claimed in claim 1, with each said attachment member being adjustable in length.

6. The pull exerciser as claimed in claim 1, with said at least one positioning hole of each said positioning block having a diameter greater than that of the end pieces of said at least one resilient cord.

7. The pull exerciser as claimed in claim 1, with said at least one positioning hole of each said positioning block having a diameter smaller than that of the end pieces of said at least one resilient cord, said at least one positioning hole of each said positioning block being communicated with outside via a reduced opening having a width smaller than a diameter of said at least one positioning hole of each said positioning block, allowing said at least one resilient cord to be inserted into said at least one positioning hole of each said positioning block via the reduced opening of said at least one positioning hole of each said positioning block.

8. The pull exerciser as claimed in claim 6, with each said positioning block further comprising at least one second positioning hole having a diameter smaller than that of the end pieces of said at least one resilient cord, said at least one second positioning hole of each said positioning block being communicated with outside via a reduced opening having a width smaller than a diameter of said at least one second positioning hole of each said positioning plate, allowing said at least one resilient cord to be inserted into said at least one second positioning hole of each said positioning block via the reduced opening of said at least one second positioning hole of each said positioning block.

9. The pull exerciser as claimed in claim 6, with said at least one positioning hole of each said positioning plate having a diameter smaller than that of the end pieces of said at least one resilient cord, said at least one positioning hole of each said positioning plate being communicated with outside via a reduced opening having a width smaller than a diameter of said at least one positioning hole of each said positioning plate, allowing said at least one resilient cord to be inserted into said at least one positioning hole of each said positioning plate via the reduced opening.

10. The pull exerciser as claimed in claim 7, with said at least one positioning hole of each said positioning plate having a diameter smaller than that of the end pieces of said at least one resilient cord, said at least one positioning hole of each said positioning plate being communicated with outside via a reduced opening having a width smaller than a diameter of said at least one positioning hole of each said positioning plate, allowing said at least one resilient cord to be inserted into said at least one positioning hole of each said positioning plate via the reduced opening.

11. The pull exerciser as claimed in claim 8, with said at least one positioning hole of each said positioning plate having a diameter smaller than that of the end pieces of said at least one resilient cord, said at least one positioning hole of each said positioning plate being communicated with outside via a reduced opening having a width smaller than a diameter of said at least one positioning hole of each said positioning plate, allowing said at least one resilient cord to be inserted into said at least one positioning hole of each said positioning plate via the reduced opening.

12. The pull exerciser as claimed in claim 10, with said reduced opening of said at least one positioning hole of each said positioning plate facing in a direction opposite to that of an associated one of the reduced openings of an associated one of the positioning blocks.

13. A pull exerciser comprising: two tubular handles; two belts that are adjustable in length, each said belt extending through an associated one of the tubular handles; two positioning devices respectively attached to the belts at a location opposite to an associated one of the tubular handles, each said positioning device including a positioning block and a positioning plate removably received in the positioning block, each of the positioning blocks and the positioning plates having a plurality of positioning holes, each said positioning hole of each said positioning plate being communicated with outside via a reduced opening having a width smaller than a diameter of each said positioning hole of each said positioning plate; and a plurality of resilient cords each having two ends, each said end of each resilient cord being insertable into an associated one of the positioning holes through the reduced opening of the associated positioning hole, each said resilient cord being extendible through the positioning holes of each said positioning block, an end piece being fixed to each of the ends of each said resilient cord and having a diameter greater than the diameter of each said positioning hole of the positioning plates, at least one of said resilient cords being selectively attached to the positioning devices.

14. The pull exerciser as claimed in claim 13, with the resilient cords having different elastic coefficients.

15. The pull exerciser as claimed in claim 13, with each said positioning hole of each said positioning plate being aligned with an associated one of the positioning holes of an associated one of the positioning blocks.

16. The pull exerciser as claimed in claim 13, with each said attachment member being adjustable in length.

17. The pull exerciser as claimed in claim 13, with each said positioning hole of each said positioning block having a diameter greater than that of the end pieces of each said resilient cord.

18. The pull exerciser as claimed in claim 13, with each said positioning hole of each said positioning block having a diameter smaller than that of the end pieces of each said resilient cord, each said positioning hole of each said positioning block being communicated with outside via a reduced opening having a width smaller than a diameter of each said positioning hole of each said positioning block, allowing each said resilient cord to be inserted into the positioning holes of the positioning blocks via the reduced opening of each said positioning hole of each said positioning block.

19. The pull exerciser as claimed in claim 18, with each said reduced opening of each said positioning plate facing in a direction opposite to that of an associated one of the reduced openings of an associated one of the positioning blocks.

20. The pull exerciser as claimed in claim 13, with at least one of the positioning holes of each said positioning block having a diameter smaller than that of the end pieces of each said resilient cord, said at least one of the positioning holes of each said positioning block being communicated with outside via a reduced opening having a width smaller than a diameter of each said positioning hole of each said positioning block, allowing an associated one of the resilient cords to be inserted into said at least one of the positioning holes of the positioning blocks via the reduced opening of said at least one of the positioning holes of each said positioning block, with at least one of the remaining positioning holes of each said positioning block having a diameter greater than that of the end pieces of the resilient cords.

* * * * *